US005671972A

United States Patent [19]

Tedesco

[11] Patent Number: 5,671,972

[45] Date of Patent: Sep. 30, 1997

[54] SEAT BACK ADJUSTMENT MECHANISM FOR A CHAIR

[75] Inventor: Romeo Tedesco, Weston, Canada

[73] Assignee: Global Upholstery Company, Downsview, Canada

[21] Appl. No.: 557,260

[22] Filed: Nov. 14, 1995

Related U.S. Application Data

[63] Continuation-in-part of Ser. No. 497,657, Jun. 30, 1995, Pat. No. 5,577,804.

[51] Int. Cl.[6] ..... B60N 2/02

[52] U.S. Cl. ..... 297/362.13; 297/361.1

[58] Field of Search ..... 297/463.1, 354.12, 297/362.13, 362.12, 362.14, 330, 411.2, 361.1; 74/500.5, 501.54

[56] References Cited

U.S. PATENT DOCUMENTS

| | | | |
|---|---|---|---|
| Re. 34,381 | 9/1993 | Barnes | 24/590 |
| 2,579,305 | 12/1951 | Cushman | 297/362.14 |
| 2,653,648 | 9/1953 | Marshall | 297/362.14 X |
| 2,863,494 | 12/1958 | Lautier et al. | 297/362.12 |
| 3,145,052 | 8/1964 | Morgan | 297/362.13 X |
| 3,223,072 | 12/1965 | Bross | 120/42.03 |
| 3,284,135 | 11/1966 | Hiramatsu | 297/361 |
| 3,578,379 | 5/1971 | Taylor et al. | 297/330 X |
| 3,730,019 | 5/1973 | Ballard | 74/502 |
| 3,889,998 | 6/1975 | Weiland | 297/330 |
| 4,072,288 | 2/1978 | Wirges et al. | 248/404 |
| 4,076,308 | 2/1978 | Slabon et al. | 297/313 |
| 4,328,943 | 5/1982 | Eldon, III | 248/578 |
| 4,353,594 | 10/1982 | Lowe | 297/307 |
| 4,354,398 | 10/1982 | Porter | 74/501 |
| 4,370,001 | 1/1983 | Ornberg | 297/355 |
| 4,373,692 | 2/1983 | Knoblauch et al. | 248/162.1 |
| 4,383,714 | 5/1983 | Ishida | 297/325 |
| 4,408,800 | 10/1983 | Knapp | 297/285 |
| 4,456,298 | 6/1984 | Gottstein | 297/353 |
| 4,595,237 | 6/1986 | Nelsen | 297/347 |
| 4,681,369 | 7/1987 | Simpson | 297/16 |
| 4,720,143 | 1/1988 | Schwartz et al. | 297/326 |
| 4,743,065 | 5/1988 | Meiller et al. | 297/300 |
| 4,838,510 | 6/1989 | Holstensson | 248/397 |
| 4,956,755 | 9/1990 | Maglica et al. | 362/206 |
| 5,024,484 | 6/1991 | Buchacz | 297/300 |
| 5,069,496 | 12/1991 | Kunh et al. | 297/300 |
| 5,090,770 | 2/1992 | Heinrichs et al. | 297/362.13 X |
| 5,137,330 | 8/1992 | Lie et al. | 297/329 |
| 5,222,783 | 6/1993 | Lai | 297/306 |

FOREIGN PATENT DOCUMENTS

| | | | |
|---|---|---|---|
| 0 052 832 | 2/1982 | European Pat. Off. . | |
| 208127 | 1/1987 | European Pat. Off. | 297/362.13 |
| 0 329 455 | 8/1989 | European Pat. Off. . | |
| 41 14 101 | 5/1992 | Germany . | |
| 405024467 | 2/1993 | Japan | 297/362.13 |
| 6277126 | 10/1994 | Japan | 297/362.13 |

*Primary Examiner*—Milton Nelson, Jr.
*Attorney, Agent, or Firm*—Richard J. Parr; Bereskin & Parr

[57] ABSTRACT

A seating unit comprises support member, a seat member; a back rest member pivotally mounted with respect to the seat member; an arm rest member having an actuating button positioned in the arm rest member, the button being movable between a first position and a second position; a cylinder containing a non-compressible fluid having actuating and operatively connected to the back rest member for adjustment of the inclination thereof; and, a flexible cable having a first end connected to the button and a second end mechanically connected to the actuating member.

29 Claims, 11 Drawing Sheets

SEAT BACK ADJUSTMENT MECHANISM FOR A CHAIR

This application is a continuation-in-part of application Ser. No. 08/497,657 filed on Jun. 30, 1995, now U.S. Pat. No. 5,577,804.

FIELD OF THE INVENTION

This invention relates to a chair having a chair back member, such as a pedestal-type office chair, wherein the inclination of the chair back may be adjusted by actuating a fluid filled cylinder. The invention also relates to an actuating mechanism for a chair having a chair back member, wherein the inclination of the chair back member may be actuated by a push button.

BACKGROUND OF THE INVENTION

Many chairs which are used in a commercial environment, such as office chairs, have a height adjusting mechanism for permitting the height of the chair to be raised or lowered to accommodate the user. Typically, height adjustment mechanisms include a fluid filled cylinder, such as a pneumatic cylinder (also known in the industry as gas dampers). These chairs may also have a chair back whose inclination with respect to the seat member may be adjusted.

Typically, office chairs comprise a wheeled base, the seat portion of the chair (which may include a chair back) and a support leg extending between the wheeled base and the seat portion. The height adjustment mechanism may employ a telescoping pneumatic cylinder which forms a part of, or may consist of, the support leg. These cylinders have a valve release pin provided thereon. The cylinder is generally in a locked condition but, when the valve release pin is depressed, the cylinder is unlocked permitting it to telescopically extend upwardly or contract downwardly.

Various control linkages for height adjustment mechanisms are known in the art. Examples of these include Kuhn et al (U.S. Pat. No. 5,069,496), Knapp (U.S. Pat. No. 4,408,800), Slabon et al (U.S. Pat. No. 4,076,308), Wirges et al (U.S. Pat. No. 4,072,288), Knoblauch et al (U.S. Pat. No. 4,373,692) and Lai (U.S. Pat. No. 5,222,783).

Numerous means have been used to control the inclination of a chair back. These include various biasing means as well as the use of pneumatic cylinders. See for example Meiller et al (U.S. Pat. No. 4,743,065), Lei et al (U.S. Pat. No. 5,137,330), Kuhn et al (U.S. Pat. No. 5,069,496), Knapp (U.S. Pat. No. 4,408,800), Simpson (U.S. Pat. No. 4,681,369), Lai (U.S. Pat. No. 5,222,783), Slabon et al (U.S. Pat. No. 4,076,308) and Hiramatsu (U.S. Pat. No. 3,284,135).

Generally, the pneumatic cylinder is adjusted by a lever or other mechanism which is positioned beneath the seat of the chair. Accordingly, the user must extend their arm downwardly and then transversely to a position underneath the seat to grasp the lever so that they can actuate the height adjustment mechanism. This operation tends to be difficult particularly if the chair has a large, bulky arm. Since the cylinder is only operable when the valve release pin is depressed, the operator must move the actuating lever to the open position and hold the lever in the open position while setting the chair in the designated position. As this may require the operator to bend or stoop over, it is difficult to set the chair position accurately. This is also problematic if the operator has a back problem which prevents such movement.

Nelsen (U.S. Pat. No. 4,595,237) discloses an actuating control for a seat height adjustment mechanism. The mechanism of Nelsen uses a pivotally mounted lever positioned on the bottom of the seat member. Nelson still requires the user to extend their arm downwardly beneath the seat to actuate the lever.

SUMMARY OF THE INVENTION

In accordance with the instant invention, there is provided a chair comprising a longitudinally extending seat member having a central portion and opposed, transversly extending front and rear ends; a wheeled base; a support member extending between the wheeled base and the central portion of the seat member; a chair back member pivotally mounted to the seat member for movement between an upright position and a reclined position; an arm rest member having an actuating button positioned in the arm rest member, the button being movable between a first position and a second position; a fluid cylinder transversely offset from the central portion having an actuating member and operatively connected to the chair back member for adjustment of the inclination thereof; and, a flexible cable having a first end connected to the button and a second end operatively connected to the actuating member whereby, when the button is moved from the first position to the second position, the actuating member is actuated so that the inclination of the chair back member may be adjusted and when the button is moved from the second position to the first position, the inclination of the chair back member is fixed.

In one embodiment, the cylinder has a telescopically extendable section, a stationary section and a valve release member moveable between a closed position in which the telescopically extendable section is fixed in position relative to the stationary section and an open position in which the telescopically extendable section is moveable relative to the stationary section, the actuating member is operatively connected to the valve release member and movable between a first position, in which the valve release member is in the closed position, and a second position, in which the valve release member is in the open position whereby, when the button means is moved from the first position to the second position, the valve release member is moved to the open position so that the inclination of the chair back member may be adjusted and when the button means is moved from the second position to the first position, the valve release member is moved to the closed position so that the inclination of the chair back member is fixed.

In such an embodiment, one of the telescopically extendable section and the stationary section is preferably mounted on the seat member and the other of the telescopically extendable section and the stationary section is pivotally connected to the chair back member. The other of the telescopically extendable section and the stationary section may be pivotally mounted on the chair back member. Alternately, the chair back member may be mounted on an attachment member, the attachment member is pivotally mounted on the seat member and the other of the telescopically extendable section and the stationary section is pivotally mounted on the attachment member.

In a further alternate embodiment, the actuating member comprises an arm member pivotally mounted with respect to the valve release member, the arm member having a moment arm of sufficient length to permit the button means to move from the first position to the second position by the force applied through a finger of the user when the user is seated in the chair. Preferably, the actuating member has a base member affixed proximate the valve release member, the arm member is pivotally mounted to the base member and movement of the arm member towards the base member causes the valve release member to move to the open position.

In a further alternate embodiment, the chair comprises a seat portion and a chair back member; the chair back member mounted on an attachment member, the attachment member pivotally mounted on the seat member; the seat portion including a fluid cylinder having longitudinally extending telescopic first and second sections and a valve release member, the first section connected to the seat portion and the second section pivotally mounted on the attachment member, the valve release member movable between a closed position in which the first and second sections are fixed in position relative to each other and an open position in which the first and second sections are moveable relative to each other; actuating means operatively connected to the valve release member; button means positioned proximate the seat member and movable between a first position and a second position; and, flexible cable means having a first end connected to the button means and a second end operatively connected to the actuator whereby, when the button means is moved from the first position to the second position, the valve release member is moved to the open position so that the inclination of the chair back member of the chair may be adjusted and when the button means is moved from the second position to the first position, the valve release member is moved to the closed position so that the inclination of the chair back member is then fixed.

Preferably, the button means is pushed inwardly (so as to undergo a inward translational movement). The button may include cam means for pulling the cable means when the button means is moved from the first position to the second position such that, as the button means is moved to the second position, the arm member pivots with respect to the valve release member and moves the valve release member to the open position.

Preferably, the chair has an arm member and the button is located in the arm member. Thus, the user may operate the chair while in a regular seated position. The user may merely push a button while sitting in the chair and be able to easily move the chair back to the desired inclination. Further, as will be apparent, a person whose back permits them to have only limited movement may be able to easily set the chair back to the desired inclination.

BRIEF DESCRIPTION OF THE DRAWINGS

These and other advantages of the instant invention will be more fully and completely understood by reference to the following drawings of the preferred embodiment of the invention in which.

DESCRIPTION OF THE PREFERRED EMBODIMENT

Figure 1:
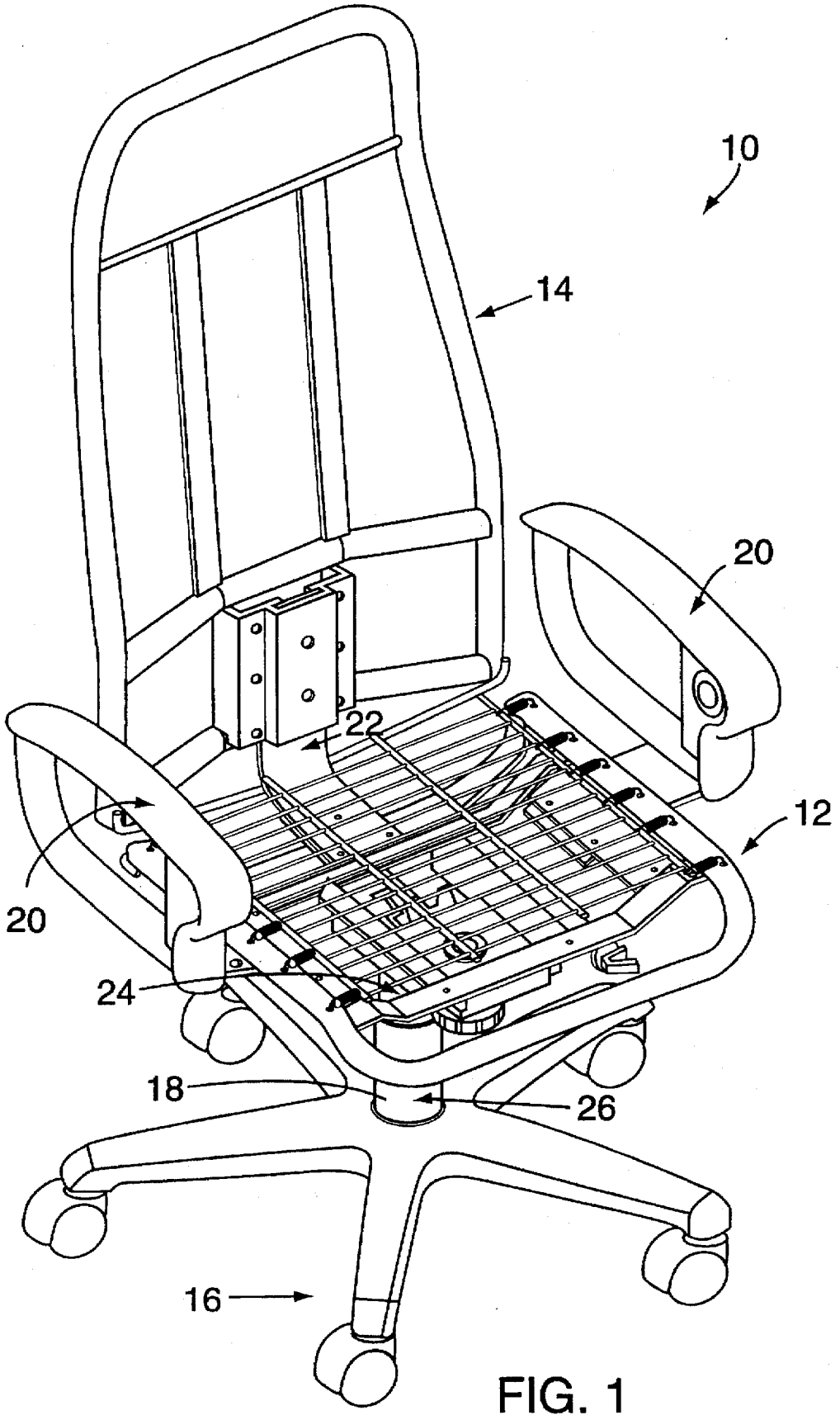
FIG. 1 is a perspective view of a chair according to the instant invention

Referring to FIG. 1, a pedestal chair is shown. For ease of reference, the foam padding of the chair has been removed so that only the frame members are visible. The chair 10 comprises seat member 12, chair back member 14, wheeled base 16 and support leg 18 extending between seat member 12 and wheeled base 16. Arms 20 are optionally provided on opposite sides of seat member 12.

Chair back member 14 is affixed to seat member 12 by back support member 22. Chair back member 14 is pivotally mounted with respect to the seat member so that the angle of inclination of chair back 14 may be varied with respect to seat member 12. Chair back member 14 may itself be pivotally mounted to seat member 12 (eg. by mounting the frame of chair back member 14 to the frame of seat member 12). Preferably, as shown in FIGS. 1 and 11, chair back member 14 is fixed to transverse rear portion 164 that is itself pivotally mounted to seat member 12.

Seat member 12 may comprise frame 150 having longitudinal side portions 152 and transverse front portion 154. Additional reinforcement may be provided to frame 150 by transverse struts 156 which extend between longitudinal side portions 152. Transverse rear portion 164 is pivotally mounted to longitudinal side portions 152 adjacent the rear ends of longitudinal side portions 152.

Struts 156 may be affixed to the lower side of the longitudinal side portions 152 by any means known in the art. For example, if side portions 152 and struts 156 are made of metal, struts 156 may be welded or bolted to side portions 152. In the preferred embodiment of FIGS. 1 and 11, each strut 156 has descending portions 158 which are connected by horizontal portion 160. Horizontal portion 160 provides a mounting platform for support leg 18 which is positioned below seat member 12.

Figure 11:
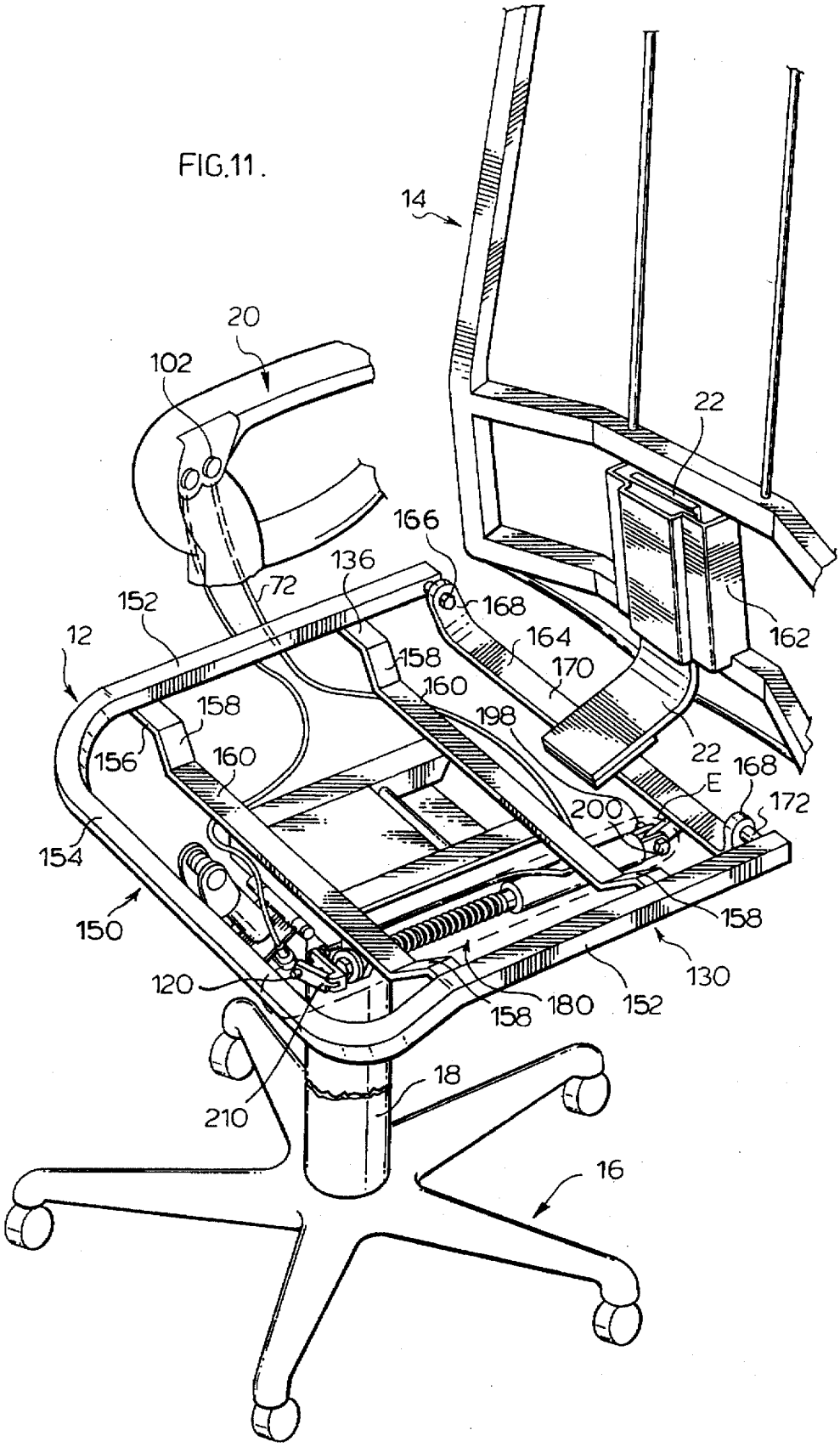
FIG. 11 is a perspective view of the chair shown in FIG. 1 wherein the spring support member for the seat member has been removed.

As shown in FIGS. 1 and 11, chair back member 14 has a mounting plate 162. The upper portion of back support member 22 is attached to mounting plate 162. For example, if back support member 22 and mounting plate 162 are made of metal, back support member 22 may be welded or bolted to mounting plate 162. Alternately, back support member 22 may be slideably received in mounting plate 162 so that the height of chair back member 14 may be adjusted with respect to seat member 12. As shown in FIGS. 1 and 11, back support member 22 may be received in a opening in mounting plate 162 which is dimensioned to fixedly hold back support member 22 in place. Similarly, the lower portion of back support member 22 is attached to transverse rear portion 164. For example, if back support member 22 and transverse rear portion 164 are made of metal, back support member 22 may be welded or bolted to transverse rear portion 164.

Transverse rear portion 164 is preferably pivotally secured to the rear portions of longitudinal side portions 152 by pivot means 166. Transverse rear portion 164 may have descending end portions 168 and central horizontal portion 170. Pivot means 166 may be any means known in the art. For example, pivot means 166 may comprise a bolt having a head (positioned on the inner surface of descending portion 168), a longitudinally extending body portion (extending through descending portion 168) and an end (positioned in longitudinal side portion 152) to which a bolt is attached. A spacer 172 may be placed over a portion of the longitudinally extending body portion of the bolt. Transverse rear portion 164 may accordingly be pivotally mounted between the bolt and spacer 172. Accordingly, chair back member 14 is fixed in position with respect to transverse member 164 and pivots with respect to seat member 12 as transverse member 164 pivots. As will be appreciated, by affixing chair back member 14 to member 164 that is pivotally mounted to seat member 12, member 164 defines a moment arm which levers the force that is applied to move seat back member 14.

Figure 2:
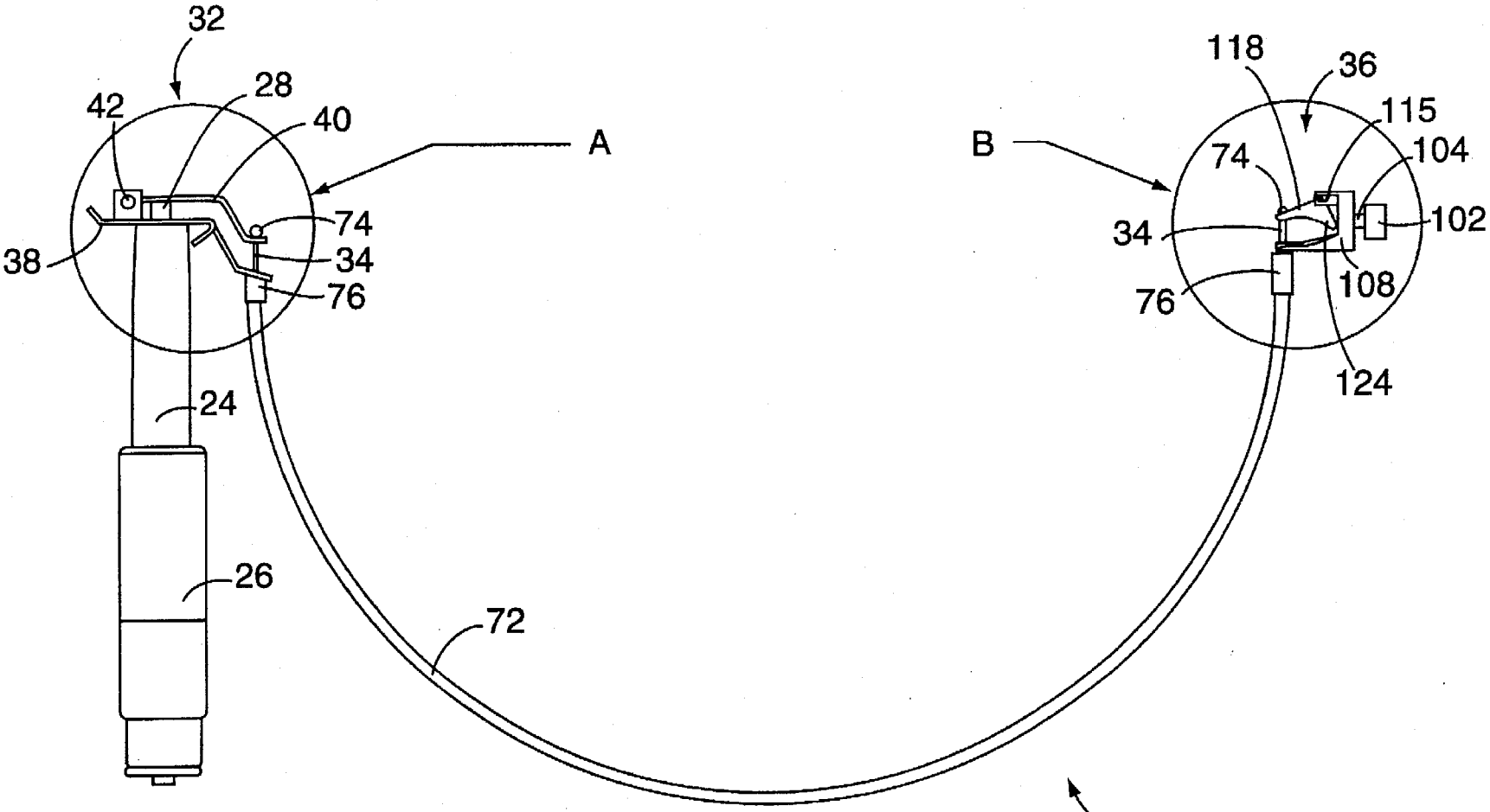
FIG. 2 is a schematic diagram of a height adjustment mechanism according to the instant invention in which the height adjustment mechanism is in the closed position.
Figure 3:
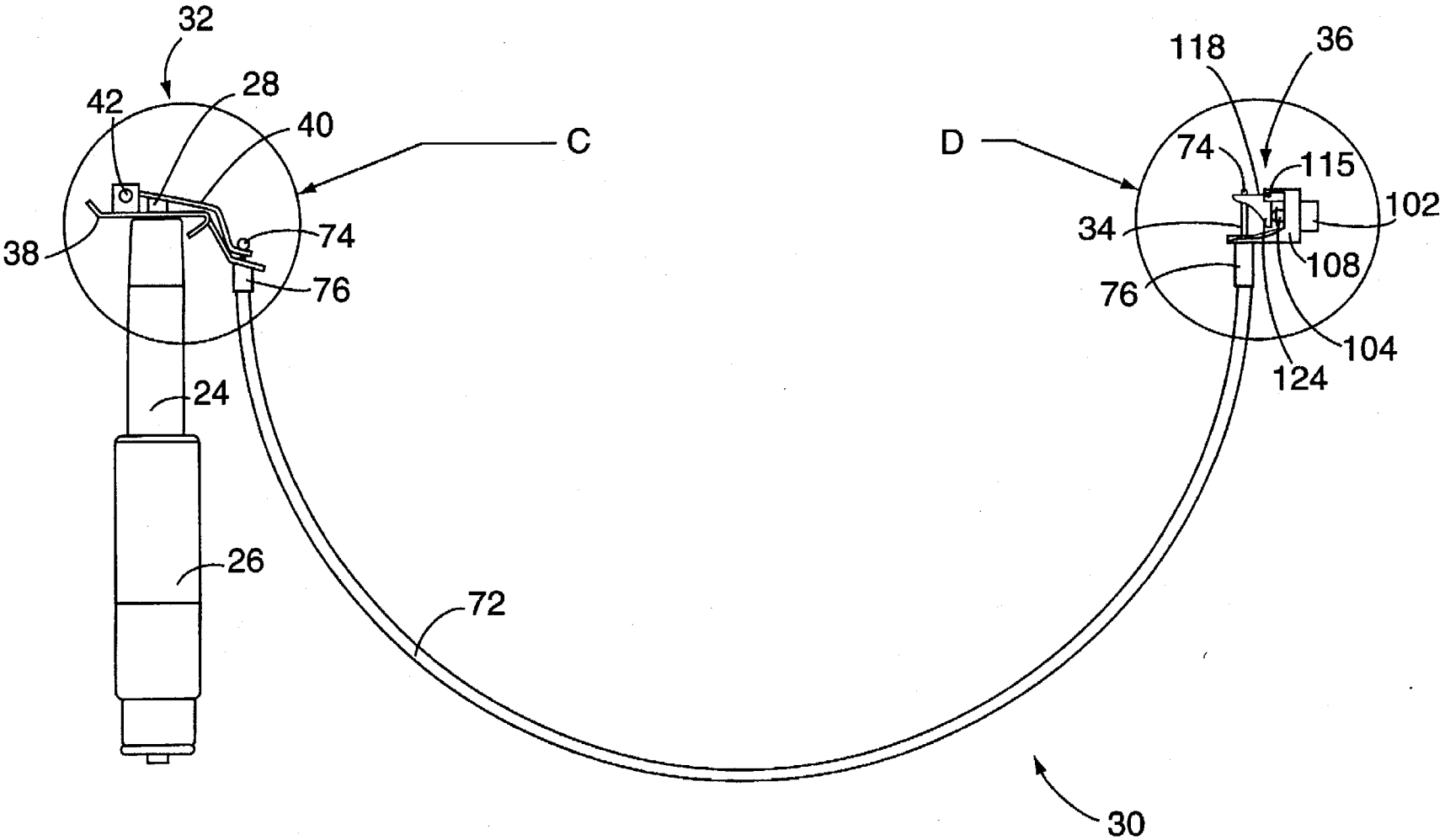
FIG. 3 is a schematic diagram of a height adjustment mechanism according to the instant invention in which the height adjustment mechanism is in the open position.

Support leg 18 comprises a telescoping cylinder having upper section 24, a lower section 26 and a valve release pin 28. The cylinder may be a fluid cylinder and is preferably a pneumatic cylinder. The cylinders are generally known in the art and have two internal chambers (now shown). When the valve release pin is in the closed position as shown in FIG. 2, the chambers are isolated from each other. Accordingly, the cylinder, and therefore the height of the chair, is locked at a predetermined position. When the valve release pin is moved to the open position as shown in FIG. 3, the two chambers are allowed to communicate permitting upper section 24 to move upwardly or downwardly with respect to lower section 24. Thus the height of the chair may be adjusted.

Typically, when the valve is released, the cylinder is designed to cause upward movement of seat member 12 when the seat is unoccupied or at least a significant portion of the user's weight is removed therefrom. By permitting seat member 12 to move upwardly under this pressure, or applying downward pressure (e.g. applying a part of the user's weight to seat member 12) the height of the chair may be decreased. When valve release pin 28 is moved to the closed position, then the communication between the chambers is terminated and the position of upper section 24 with respect to lower section 26 is fixed.

Generally, valve release pin 28 is positioned on the top of upper section 24 (see for example FIG. 2). However, as will be discussed more fully below, due to the construction of the actuator for the height adjustment mechanism of the instant invention, the valve release pin may be positioned at any desired location on the cylinder.

Figure 9:
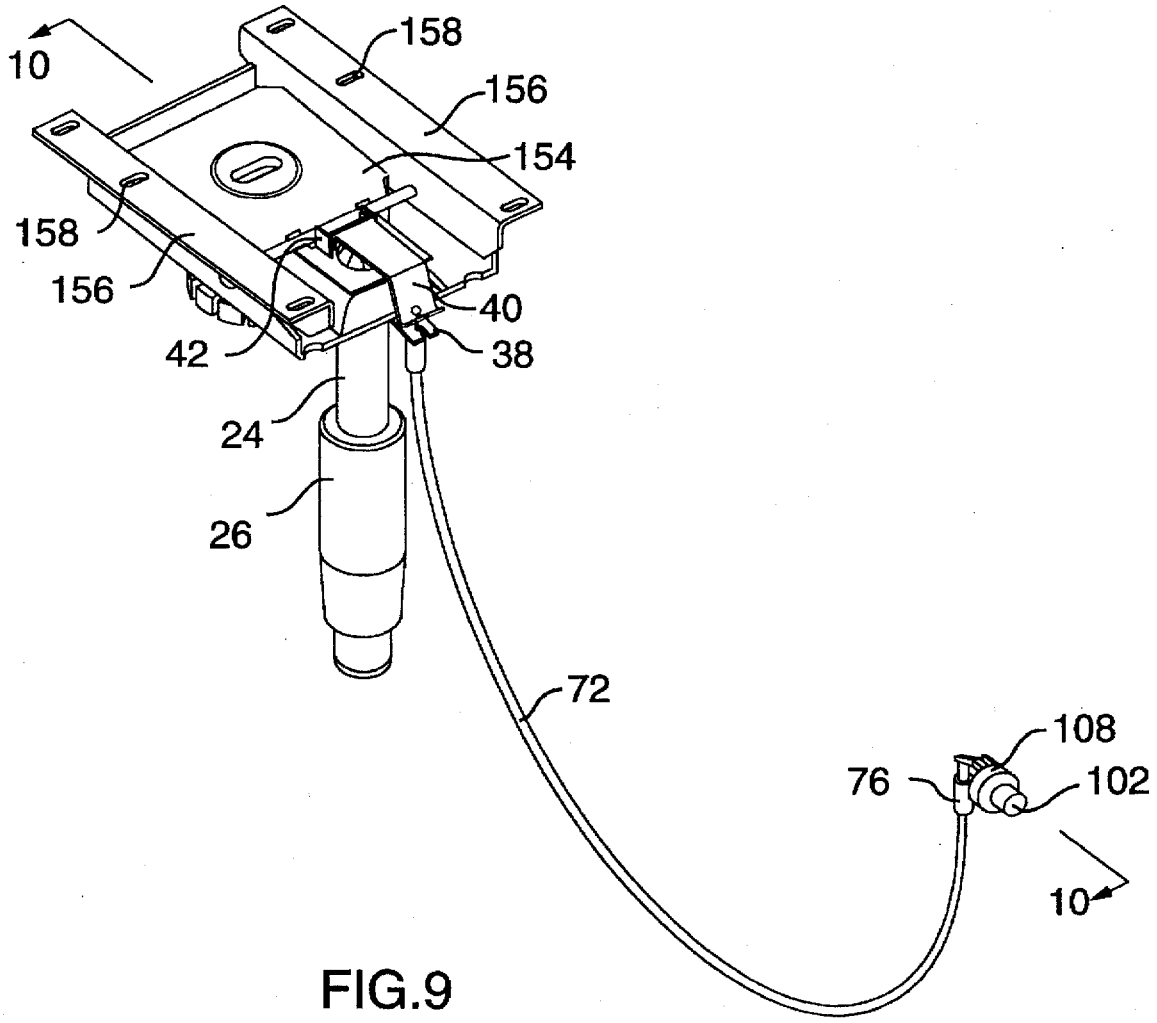
FIG. 9 is a schematic diagram of a height adjustment mechanism according to the instant invention when affixed to the seat support member.
Figure 10:
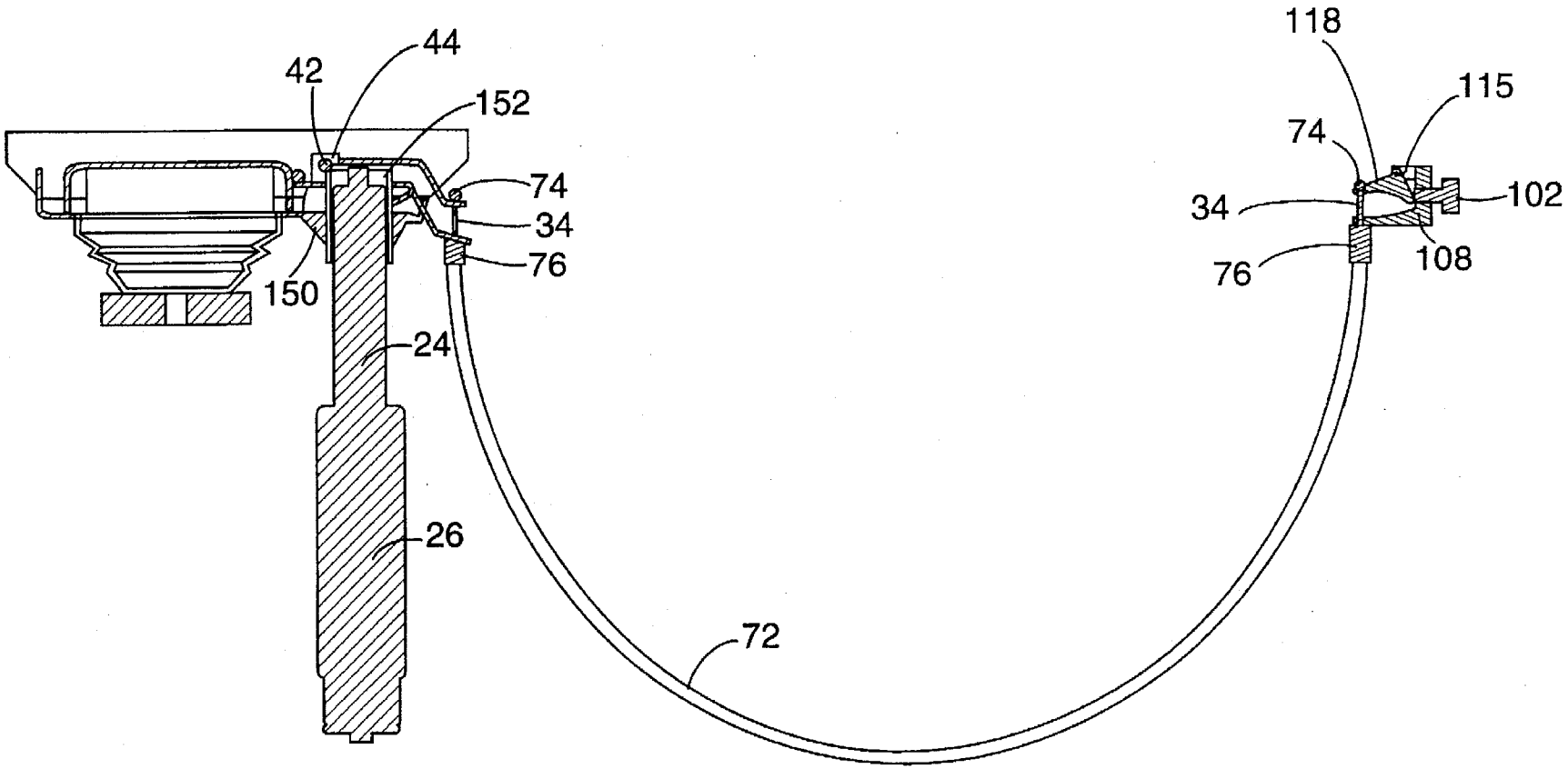
FIG. 10 is a cross section along line 10 —10 in FIG. 9.

As shown in FIGS. 9 and 10, upper section 24 is received in bushing 150 which has an opening 152. Bushing 150 is a tapered bushing. Similarly, the upper portion of upper section 24 is tapered. Accordingly, upper section 24 is mounted in bushing 152 by means of a taper fit as is known in the art. Bushing 150 is affixed to plate 154. Plate 154 has upraised flanges 156 which have a plurality of openings 158 provided therein. Seat member 12 may be affixed to plate 154 by means of screws passing through openings 158 and into the bottom portion of seat member 12.

Typically, pedestal type chairs may include additional mechanisms to adjust the position of the chair for the comfort of the user. These include means for tilting seat member 12 with respect to support leg 18. These devices may be mounted, as is normal in the trade, below the seat member. Many of these devices are known in the art and some are referred to in the patents referred to above in the portion of this specification entitled "Background of the Invention". As will be appreciated during the discussion of the instant actuating member, the actuating member of this invention may be used in a chair that contains one or more of these devices.

Referring to FIGS. 2 and 3, actuating mechanism 30 of the instant invention is shown isolated from chair 10. Actuating means 30 comprises actuator 32, button means 36 and cable 34 extending between actuator 32 and button means 36.

As valve release pin 28 is mounted on top of upper section 24 of the cylinder, actuator 32 is also mounted thereon. Actuator 32 has a lower plate 38, upper pivoting arm 40 and pivot axle 42. Pivot axle 42 is mounted between a pair of flanges 44 which extend upwardly from plate 38. Plate 38 is positioned on top of upper section 24 of the cylinder and provides a fixed mount for pivot axle 42. As will be appreciated, plate 38 may be of any particular shape and any particular orientation provided that a fixed mount is provided for pivot axle 42.

In particular, it is appreciated that seat member 12 must be fixed on top of section 24 and that additional mechanisms, including a back angle adjustment mechanism and a tilt mechanism for seat member 12 may be provided or that a different method may be used to affix upper section 24 to seat member 12. The addition of these mechanisms may require a different orientation and configuration for plate 38.

Figure 6:
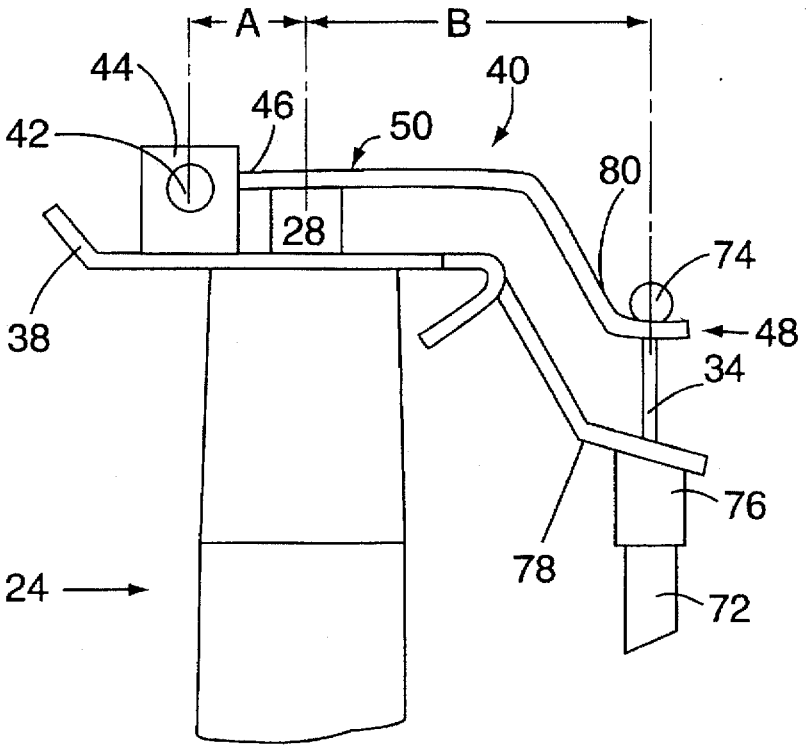
FIG. 6 is an enlargement of detail A of FIG. 2 showing the actuator means in the closed position.
Figure 7:
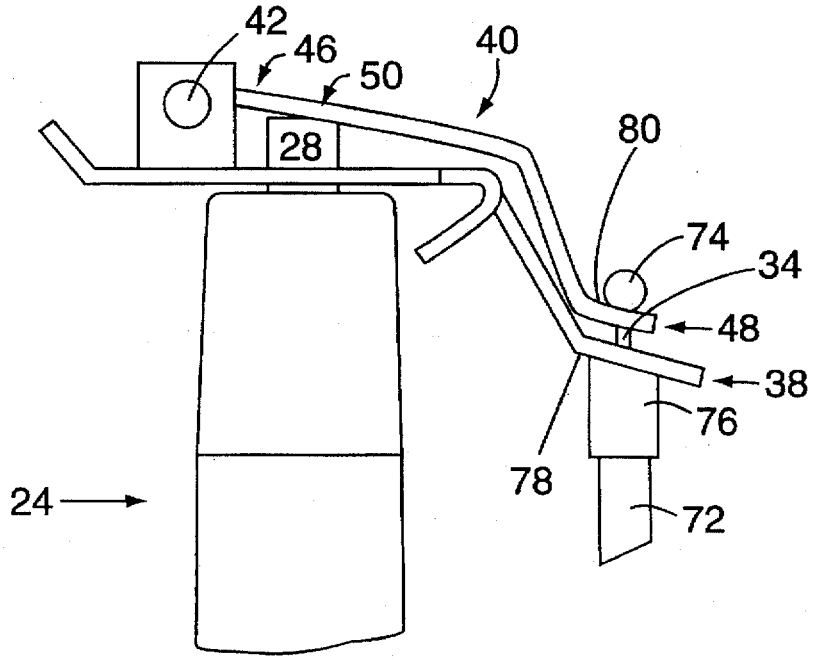
FIG. 7 is an enlargement of detail C of FIG. 3 showing the actuator means in the closed position.

Referring to FIGS. 6 and 7, pivoting arm 40 has a first portion 46, second portion 48 and a third portion 50. First portion 46 is pivotally mounted for rotation about pivot axle 42. Second portion is adapted to be affixed to cable 14. Third portion 50 is adapted for contacting valve 28.

Figure 8:
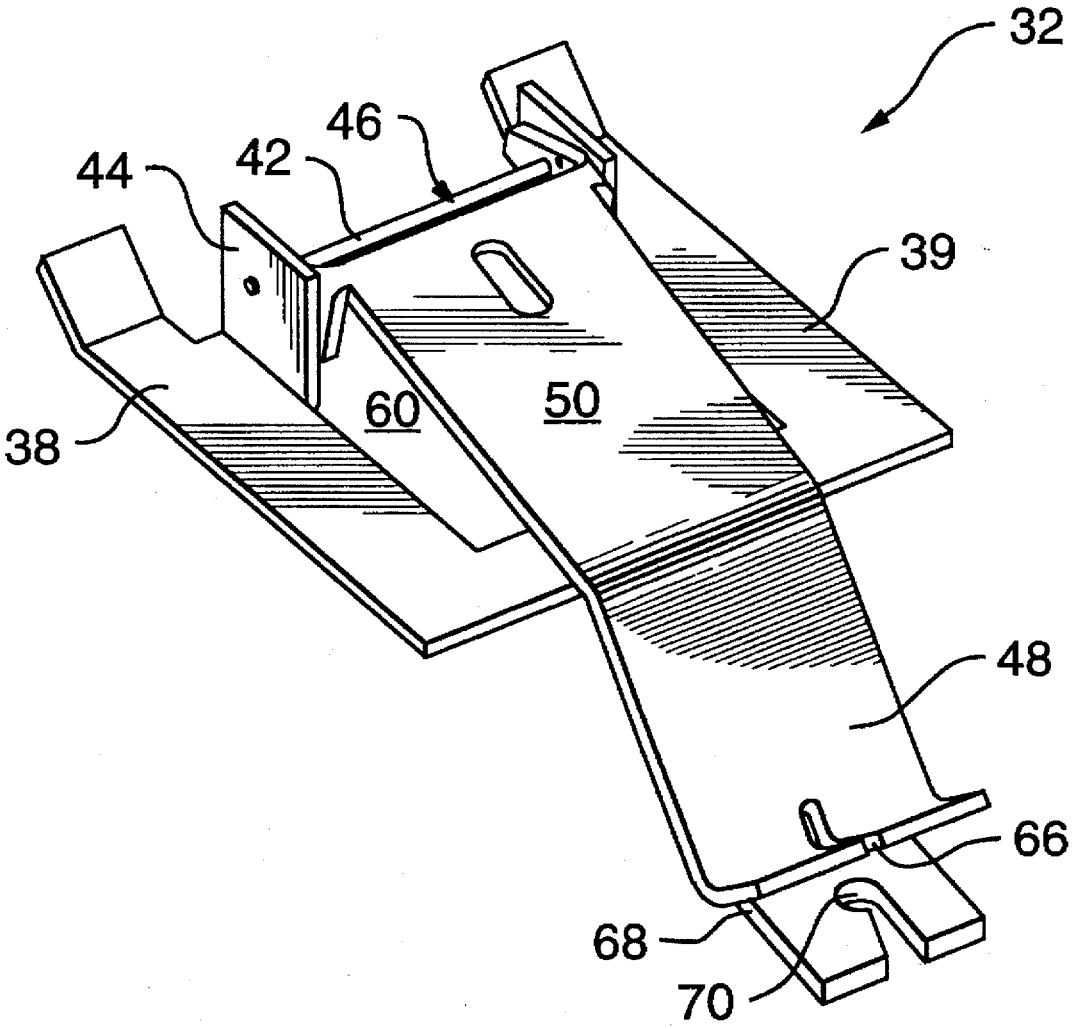
FIG. 8 is a perspective view of an actuator for the height adjustment mechanism.

Referring to FIG. 8, actuator 32 is shown in more detail. As can be seen in this view, plate 38 comprises a longitudinally extending generally flat member 39 having a central opening designated by reference numeral 60. When actuator 32 is positioned on top of upper section 24 of the cylinder, pin 28 extends upwardly through opening 60 and contacts the lower surface of third portion 50. Flanges 44 extend upwardly from generally flat member 39. First portion 46 of pivot arm 40 wraps around pivot axle 42 so that arm 40 may pivot upwardly and downwardly with respect to plate 38.

Second portion 48 of pivot arm 40 has a cable retaining opening 66 provided therein. Plate 38 has a descending portion 68 to match that of arm 40. Opening 70 is provided in the front thereof.

Reference will now be made to FIGS. 6 and 7 which show a schematic of actuator 32 positioned on top of the cylinder with the cable attached. Cable 34 may be made of a variety of materials which may accept a tensional force without breaking, e.g. braided wire. Cable 34 may be sheathed in a plastic or like housing 72 to permit the smooth movement of cable 34 therein. Cable 34 is provided with enlarged end 74. Housing 74 has shoulder members 76 which abut against lower surface 78 of descending portion 68. Cable 34 passes through openings 66 and 70. Enlarged end 74 is retained on upper surface 80 of second portion 48, such as by providing a recess in which enlarged end 74 is seated, while permitting cable 34 to pass through opening 66 and 70.

Figure 4:
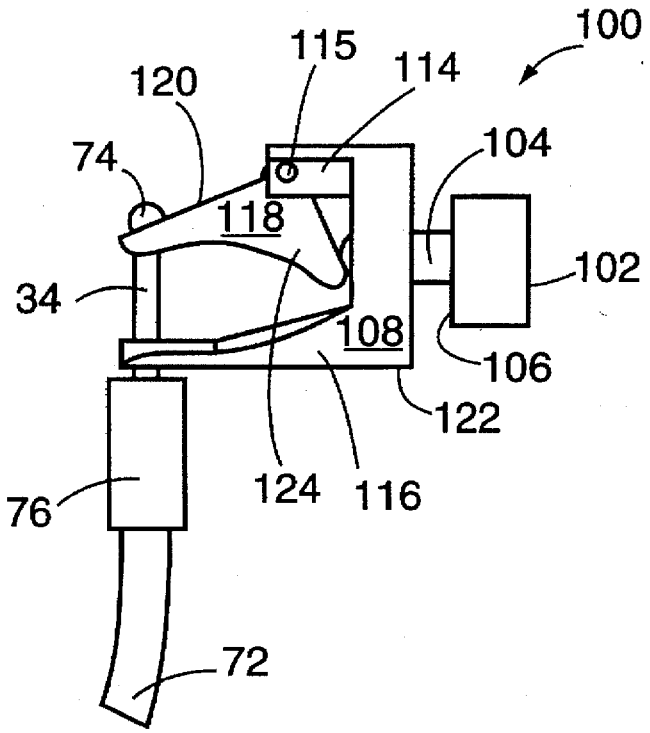
FIG. 4 is an enlargement of detail B of FIG. 2 showing the button means in the closed position.
Figure 5:
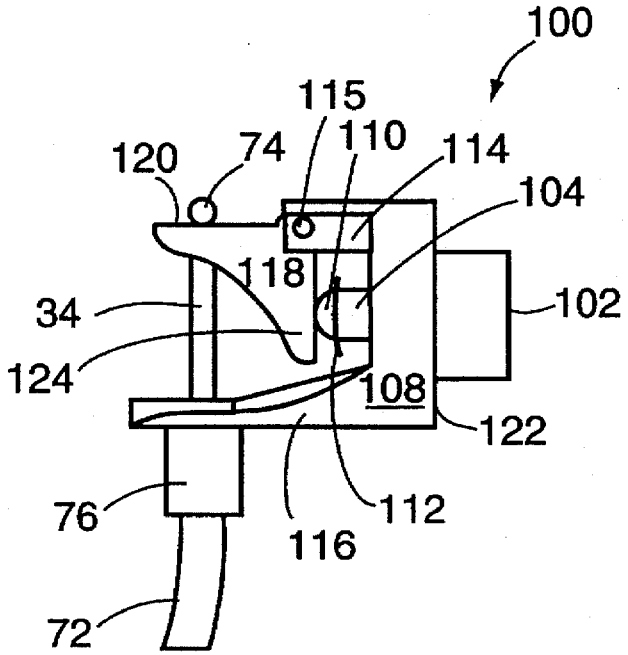
FIG. 5 is an enlargement of detail D of FIG. 3 showing the button means in the open position.

Button means 100 is shown in FIGS. 4 and 5. Button means 100 comprises button 102 and transversely extending member 104. Transversely extending member 104 extends outwardly from rear surface 106 of button 102. Transversely extending member 104 extends through an opening (see FIG. 10) in housing 108. Transversely extending member 104 has distal end 110 on which is provided disk member 112. Disk member 112 has a larger diameter than transversely extending member 104 so as to retain button 102 within housing 108.

Housing 108 has a first arm 114 and a second arm 116. Cam member 118 is pivotally mounted on pivot axle 115 which is located at the distal end of first arm 114. As discussed above with respect to actuator 32, cable 34 has a shoulder member 76 and the end of cable 34 connected to button means 100 has an enlarged end 74. Cam member 118 is provided with an opening (see FIG. 10) through which cable 34 passes. Enlarged end 74 is retained against surface 120 of cam member 118 such as by providing a recess in which enlarged end 74 is seated. Second arm member 116 has an opening (see FIG. 10) through which cable 34 passes. Shoulder member 76 abuts against lower surface 122 of second arm 116.

It will be appreciated that cable 34 may be retained in first portion 48 and cam member 118 by any means known in the art. Cable 34 may be fixedly attached thereto, (e.g. by welding, gluing or the like). Alternately, cable 34 may be removably connected thereto for ease of repair in case cable 34 should break.

Referring to FIGS. 2 and 3, the operation of the actuating means will now be described. Referring first to FIG. 2, valve release pin 28 is shown in the closed position. In this position, pin 28 is in its raised position. Due to the construction of the cylinder, pin 28 is biased into this position so that the cylinder will not be prematurely activated. The pressure exerted by pin 28 against arm 40 causes arm 40 to be maintained in a raised position with respect to plate 38. This force on arm 40 is transmitted through cable 34 and therefore maintains cam member 118 in the position shown in FIG. 2. Arm 124 of cam member 118 transmits this force outwardly through transversely extending member 104 to button 102.

When the user wishes to adjust the height of the chair, they push inwardly on button 102 with, for example, their thumb. This causes button 102 to move to the position shown in FIG. 3. When button 102 is pushed inwardly, transversely extending member 104 pushes on arm 124 of cam member 118 moving cam member 118 to the position shown in FIG. 3. This movement of cam member 118 causes cable 34 to draw arm 40 of actuator 32 downwardly towards plate 38 of actuator 32. By this movement, valve pin 28 is forced downwardly to the open position thus permitting upper section 24 to telescope either upwardly or downwardly with respect to lower section 26. When the chair has been moved to the desired position, the user releases button 102 permitting valve 28 to move arm 40 to the raised position shown in FIG. 3 thus closing the valve. In this position, the chair is once again fixed at a particular, desired height.

Referring to FIG. 6, it will be appreciated that arm 40 provides a moment arm to reduce the pressure which must be exerted by the user to move valve release pin 28 from the closed position to the open position. In particular, the distance between pivot pin 28 and cable 34, referred to by reference numeral B in FIG. 6, provides a moment arm which is substantially longer in the distance between pivot axle 42 and valve release pin 28 (referred to by reference numeral A). By varying the length of moment arm B with respect to A, the amount of force which must be applied, and the distance through which cable 34 must travel, may be adjusted. Preferably, the length of movement arm B with respect to A, and its configuration, are sufficient to permit button 102 to be depressed when a relatively low force is applied by the user, e.g. that pressure which may be applied by the average person. If moment arm B is too long or the distance which must be travelled by second portion 48 is too short, then the height adjustment means may be accidentally actuated by the user by merely brushing against button 102. The ratio of the distances B to A preferably varies from about 1.5:1 to about 5:1, more preferably from about 2:1 to about 4:1 and, most preferably, the ratio is about 3:1.

By constructing actuator 32 according to this invention, the amount of pressure directed downwardly on valve pin 28 by pivot arm 40 may be substantially greater than the pressure required to depress button 102. Preferably, a pressure of from abut 10 to about 20, more preferably from about 15 to about 20 lbs., is required to move valve release pin 28 to the open position. In such a case, the pressure required to move button 102 may vary from about 5 to about 10 lbs. and, more preferably, is about 8 lbs. If the pressure required to move button 102 is less than about 5 lbs., then button 102 may be accidentally actuated by the user brushing against it. If the pressure is greater than about 10 lbs., then the pressure may be too great for many users to easily actuate the height adjustment mechanism. It has been found that a pressure of about 8 lbs. is optimal.

Generally, the arms of chairs are relatively thin. Thus, to fit button means 100 in the arm of a chair, button 102 generally has a relatively short stroke between the released position shown in FIG. 4 and the depressed position shown in FIG. 5. Preferably, the distance travelled by button 102 may be up to about ¾ of an inch but, preferably is about ⅝ of an inch. Correspondingly, the distance travelled by third portion 50 is preferably about ¼ of an inch. Thus, due to the length of moment arm B, the ratio of the distance travelled by button 102 to third portion 50 is about 2:1. This permits about a corresponding increase in the magnitude of the force applied by third portion 50 to valve release pin 28.

Figure 13:
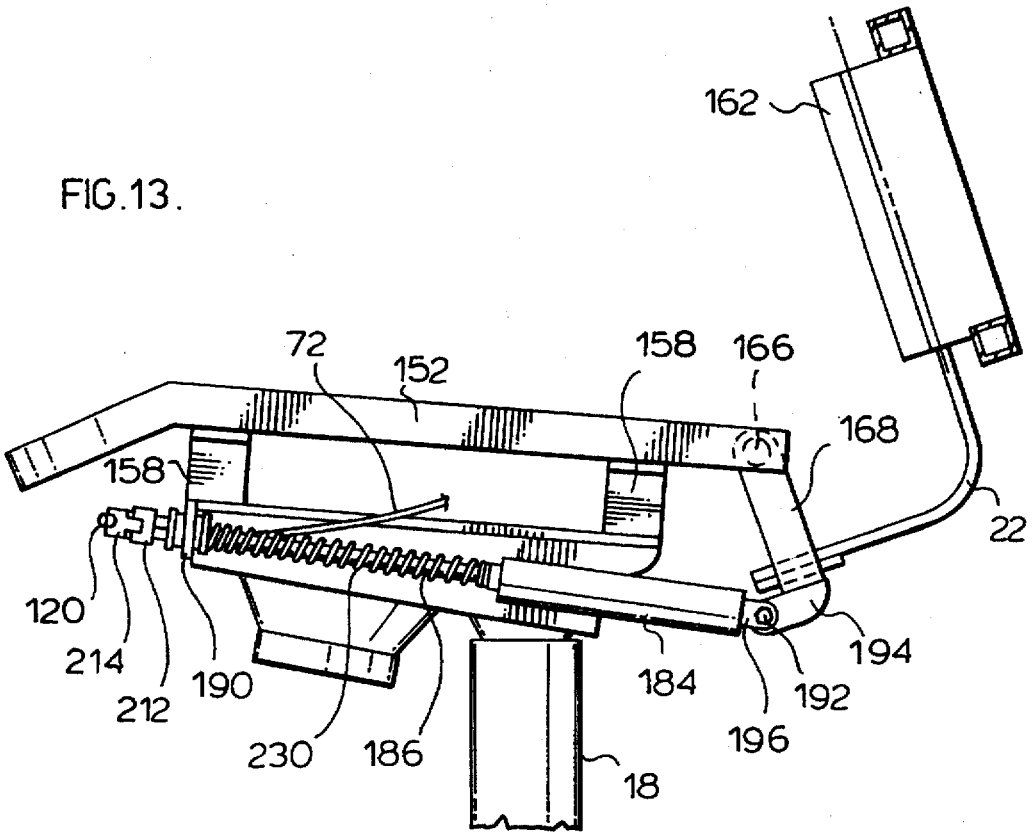
FIG. 13 is a side view of the chair of FIG. 11 in which the chair back is in an upright position; and, FIG. 14 is a side view of the chair of FIG. 11 in which the chair back is in an inclined position.
Figure 14:
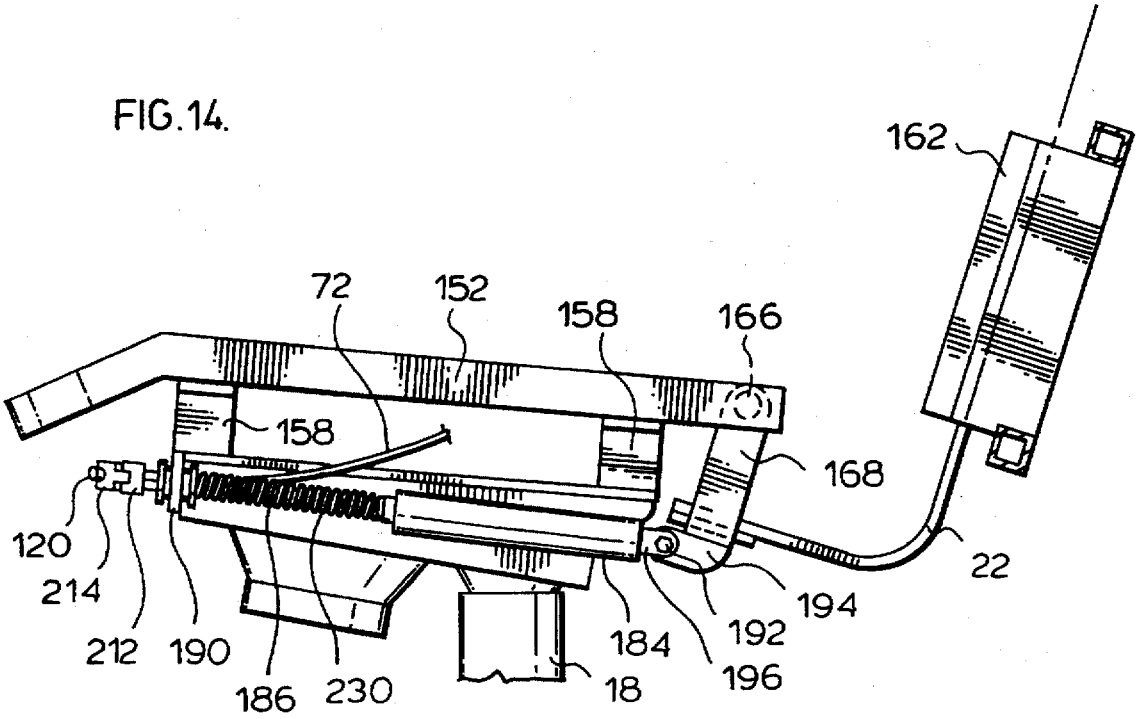

As shown in FIGS. 11, 13 and 14, tilt adjustment mechanism 180 is mounted offset to one side, and in the plane of, seat member 12. Mechanism 180 comprises motion control fluid cylinder 182 having stationary housing 184, telescopically expandable piston 186 mounted therein and valve release pin 188. Motion control fluid cylinder 182 is preferably fixedly mounted to the forward portion of seat member 12 by means of forward mount 190 and, preferably, pivotally mounted to the rear of seat member 12 by rearward pivot mount 192.

Motion control fluid cylinder 182 may be a fluid cylinder and is preferably filled with a non-compressible fluid (e.g. oil). As is known in the art, motion control fluid cylinder 182 has two internal chambers which are isolated from each other by means of a valve (not shown). When the valve is opened, fluid may flow from one chamber to the other thus allowing telescopically expandable piston 186 to expand forwardly, or contract rearwardly, with respect to stationary housing 184. When valve release pin 188 is in the closed position, then the valve is closed and the two chambers are isolated from each other so that piston 186 is fixed in position with respect to housing 184. Accordingly, the inclination of chair back member 14 is fixed in position when valve release pin 188 is in the closed position. When valve release pin 188 is moved to the open position, then the valve is open and the two chambers are allowed to communicate permitting piston 186 to expand outwardly from housing 184 or to contract inwardly into housing 184 so that the inclination chair back member 14 may be adjusted either forwardly or rearwardly.

Forward mount 190 may comprise a flange which descends from the lower surface of horizontal portion 160. The forward end of piston 186 extends through an opening in the flange and is fixedly mounted thereto. Piston 186 may be fixedly mounted thereto by any means known in the art. Therefore, any movement of piston 186 with respect to housing 184 causes housing 184 to move rearwardly.

Figure 12:
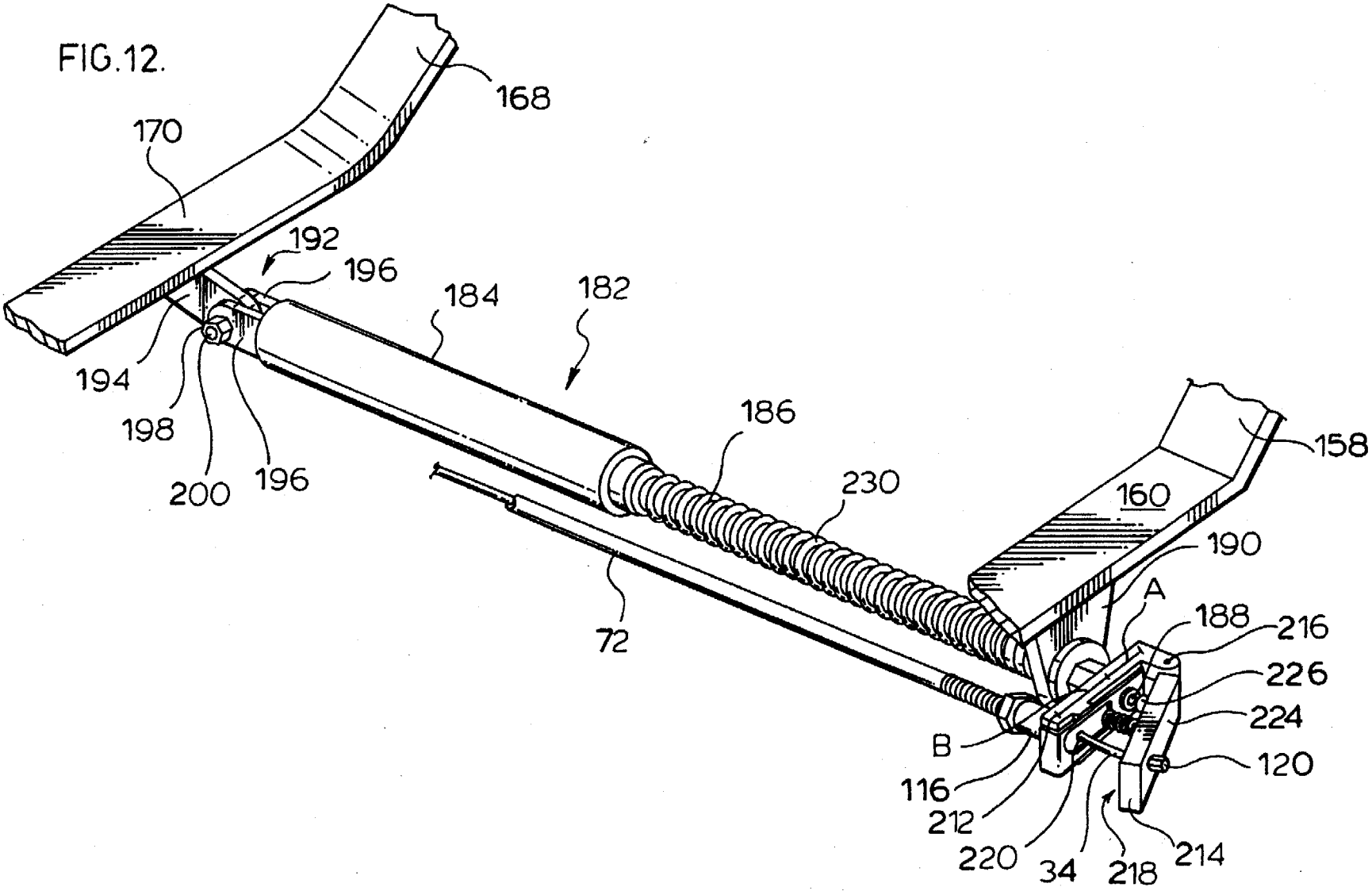
FIG. 12 is an enlargement of detail E of FIG. 11.

Rearward pivot mount 192 may comprise flange 194 and extension arms 196. Referring to FIGS. 13 and 14, flange 194 extends forwardly from the lower surface of horizontal portion 170. Extension arms 196 extend rearwardly from housing 184. Extension arms 196 may be pivotally connected to flange 194 by any means known in the art. As shown in FIGS. 11 and 12, extension arms 196 are pivotally connected to flange 194 by means of bolt 198 and screw 200.

Actuator 210 is mounted on the forward portion of piston 186 at a position forward of mount 190. Actuator 210 has a stationary arm 212 and pivoting arm 214 which is pivotally connected to stationary arm 212 by pivot pin 216. Stationary arm 212 may be affixed to piston 186 by any means known in the art that provides a fixed amount for pivot pin 216. As will be appreciated, stationary arm 212 may be of any particular shape that provides a fixed mount for pivot pin 216. Pivoting arm 214 has inner surface 218.

The distal end of arm 212 from pivot pin 216 is provided with opening 220. Similarly, the distal end of pivoting arm 214 from pivot pin 216 is provided with an opening (not shown). As discussed above with respect to the height adjustment actuator, cable 114 comprises, e.g. a braided wire 34, which is held within a plastic like housing 72 to permit smooth movement of wire 34 therein. Wire 34 is provided with enlarged end 120. Cable 114 is provided with shoulder member 116 which abuts against stationary arm 212. Wire 34 passes through the openings in arms 212 and 214. Enlarged end 120 is retained on outer surface 224 of pivoting arm 214, such as by providing a recess in which enlarged end 120 is seated, while permitting wire 34 to pass through the openings in arms 212 and 214.

An opening is provided in stationary arm 212 so that, as pivoting arm 214 moves towards stationary arm 212, release pin 188 is moved from the closed position (in which piston 186 is fixed in position with respect to housing 184) to the open position (in which piston 186 may move with respect to housing 184). To this end, as shown in FIG. 12, valve release pin may extend outwardly through stationary arm 212. Inner surface 218 of pivoting arm 214 may be flat so that as arm 214 pivots towards stationary arm 212, valve release pin 188 is depressed into housing 184 thus opening the valve. Alternately, as shown in FIG. 12, it will be appreciated that protrusion 226 or other button means may be provided on inner surface 218 to contact valve release pin 188 and that valve release pin 188 may be recessed within stationary arm 212 if the button means is of sufficient size.

As with the height adjustment means, wire 34 is affixed to a second button means 100 as is shown in FIGS. 4 and 5. The button means 100 which operates actuator 210 may be positioned beside the button means 100 which operates actuator 32. Alternately, the button means 100 which operates actuator 210 may be positioned in the other arm 20 from the button means 100 which operates actuator 32.

The operation of actuator 210 will now be described. Valve release pin 188 is biased to the closed position (the raised position as shown herein). Due to the construction of the cylinder, valve release pin 188 is biased into this position so that cylinder 72 will not be prematurely actuated. The pressure exerted by valve release pin 188 against arm 214 causes arm 214 to be maintained in the distal position with respect to stationary arm 212. Optionally, spring means 232, which extends between arms 212 and 214, may be provided to assist in maintaining arm 214 in the distal position. This force upon arm 214 is transmitted through wire 34 and therefore retains cam member 118 in the position shown in FIG. 4. Arm 124 of cam member 118 transmits this force outwardly through transversely extending member 104 to button 102 so that button 102 is in the raised position shown in FIG. 6.

When the user wishes to adjust the inclination of chair back 14 chair, they push inwardly on button 102 with, for example, their thumb. This causes button 102 to move to the recessed (open) position shown in FIG. 5. When button 102 is pushed inwardly, transversely extending member 104 pushes on arm 124 of cam member 118 moving cam member 118 to the position shown in FIG. 5. This movement of cam member 118 causes cable 34 to draw arm 214 towards stationary arm 212. By this movement, valve release pin 188 is forced inwardly into the cylinder thus permitting piston 186 to telescope either inwardly or outwardly with respect to housing 184. When chair back member 14 has been moved to the desired position, the user releases button 102 permitting valve release pin 188 to move arm 214 to the distal (closed) position thus closing the valve. In this position, the inclination of the chair back is once again fixed at the desired inclination. In order to bias, or assist in biasing chair back 14 to an upright position, spring 230 may be placed on piston 186. Spring 230 imparts a rearward force to housing 184. Thus, when valve release pin 188 is in the open position and the worker does not apply any force to chair back 14, chair back 14 will move to an upright position.

Referring to FIG. 12, it will be appreciated that arm 214 provides a moment arm to reduce the pressure which must be exerted by the user to move valve release pin 188 from the closed position to the open position. In particular, the distance between valve release pin 188 and wire 34, referred to by reference numeral B in FIG. 12, provides a moment arm which is substantially longer than the distance between pivot pin 216 and valve release pin 188, referred to by reference numeral A. By varying the length of moment arm B with respect to A, the amount of force which must be applied, and the distance through which wire 34 must travel, may be adjusted. Preferably, the length of moment arm B with respect to A, and it's configuration, are sufficient to permit button 102 to be depressed when a relatively low force is applied by the user, e.g. that pressure which may be applied through a finger by the average person. If moment arm B is too long, or the distance which must be travelled by arm 214 is too short, then the adjustment mechanism may be accidentally actuated by the user by merely brushing against button 102. The ratio of the distances B to A preferably varies from about 2:1 to about 3:1 and more preferably about 2.5:1.

By constructing actuator 210 according to this invention, the amount of pressure directed on the valve release pin 188 by pivot arm 214 may be substantially greater than the pressure required to depress button 102. Preferably, a pressure of from abut 10 to about 20 lbs., more preferably from about 15 to about 20 lbs., is required to move valve release pin 188 to the open position. In such a case, the pressure required to move button 102 may vary from about 5 to about 10 lbs. and, more preferably, is about 8 lbs. If the pressure required to move button 102 is less than about 5 pounds, then button 102 may be accidentally actuated by the user brushing against it. If the pressure is greater than about 10 pounds, then the pressure may be too great for many users to easily actuate the height adjustment mechanism. It has been found that the pressure from about 8 pounds is optimal.

It will be appreciated by those skilled in the art that various modifications to actuator 32 may be permissible. For example, if the cylinder was actuated by the outward (upward) movement of valve release pin 28, then, button means 102 could be designed to release tension in cable 34, permitting the expansion outwardly of valve release pin 28, as opposed to providing a tensional force thereto as shown herein. Further, as will be appreciated by those skilled in the art, the exact configuration and orientation of plate 38 may be adjusted so long as a fixed mount is provided for pivot axle 42. Further, the exact configuration and orientation of arm 40 may be varied. A similar modification could be made to actuator 210.

In an alternate embodiment, button 102 may be designed so as to be capable of being locked in both the open position and the closed position. Thus, when button 102 is in the raised, closed position as shown in FIG. 4, the inclination of chair back 14 may be locked in an upright position or in an inclined position with respect to seat member 12. Alternately, when button 102 is locked in the recessed, open position as shown in FIG. 5, chair back 14 may be rocked backwards and/or forwards with respect to the seat member 12.

I claim:

1. A chair comprising:

(i) a longitudinally extending seat member having a central portion and opposed, transversely extending front and rear ends;

(ii) a wheeled base;

(iii) a support member extending between said wheeled base and said central portion of said seat member;

(iv) a chair back member pivotally mounted with respect to said seat member for movement between an upright position and a reclined position;

(v) an arm rest member having button means positioned in said arm rest member, said button means being movable between a first position and a second position;

(vi) a cylinder containing a non-compressible fluid transversely offset from said central portion, having mechanical actuating means and operatively connected to said chair back member for adjustment of the inclination thereof; and, (vii) flexible cable means having a first end connected to said button means and a second end mechanically connected to said actuating means whereby, when said button means is moved from said first position to said second position, said actuating means is actuated so that the inclination of the chair back member may be adjusted and when said button means is moved from said second position to said first position, the inclination of the chair back member is fixed.

2. The chair as claimed in claim 1 wherein said button means is positioned in a housing and said button means travels inwardly into said housing as said button means passes between said first and second positions.

3. The chair as claimed in claim 1 wherein said fluid cylinder has spring means to bias said chair back member to said upright position.

4. The chair as claimed in claim 2 wherein a force from about 5 to about 10 lbs is required to move said button means from said first position to said second position.

5. The chair as claimed in claim 1 wherein the distance between said first position and said second position of said button means is up to about ⅝ inch.

6. The chair as claimed in claim 1 wherein said cylinder has a telescopically extendable section, a stationary section and a valve release member moveable between a closed position in which said telescopically extendable section is fixed in position relative to said stationary section and an open position in which said telescopically extendable section is moveable relative to said stationary section, said actuating means is operatively connected to said valve release member and movable between a first position, in which said valve release member is in said closed position, and a second position, in which said valve release member is in said open position whereby, when said button means is moved from said first position to said second position, said valve release member is moved to said open position so that the inclination of said chair back member may be adjusted and when said button means is moved from said second position to said first position, said valve release member is moved to said closed position so that the inclination of said chair back member is fixed.

7. The chair as claimed in claim 6 wherein said actuating means comprises an arm member pivotally mounted with respect to said valve release member, said arm member having a moment arm of sufficient length to permit said button means to move from said first position to said second position by a force applied through a finger of a user when said user is seated in the chair.

8. The chair as claimed in claim 7 wherein said actuating means has a base member affixed proximate said valve release member, said arm member is pivotally mounted to said base member and movement of said arm member towards said base member causes said valve release member to move to said open position.

9. The chair as claimed in claim 8 wherein said button means includes cam means for pulling said cable means when said button means is moved from said first position to said second position such that, as said button means is moved to said second position, said arm member pivots with respect to said valve release member and moves said valve release member to said open position.

10. The chair as claimed in claim 6 wherein said one of said telescopically extendable section and said stationary section is mounted on said seat member and the other of said telescopically extendable section and said stationary section is pivotally connected to said chair back member.

11. The chair as claimed in claim 10 wherein said chair back member is pivotally mounted on said seat member and said other of said telescopically extendable section and said stationary section is pivotally mounted on said chair back member.

12. The chair as claimed in claim 11 wherein said chair back member is fixedly mounted on an attachment member, said attachment member is pivotally mounted on said seat member and said other of said telescopically extendable section and said stationary section is pivotally mounted on said attachment member.

13. The chair as claimed in claim 2 wherein said buttons means has detent means for alternately maintaining said button means in said first position and said second position.

14. A chair comprising:

(i) a seat member, a chair back member and an arm rest member, said chair back member pivotally mounted with respect to said seat portion;

(ii) said seat member including a cylinder containing a non-compressible fluid having longitudinally extending telescopic first and second sections and a valve release member, said first section connected to said seat member and said second section in pivotal connection with said chair back member, said valve release member movable between a closed position in which said first and second sections are fixed in position relative to each other and an open position in which said first and second sections are moveable relative to each other;

(iii) an arm member pivotally mounted with respect to said valve release member and movable between a first position in which said valve release member is in said closed position and a second position in which said valve release member is in said open position;

(iv) button means positioned in said arm rest member and movable between a first position and a second position, said arm member having a moment arm of sufficient length to permit said button means to move from said first position to said second position by a force applied through a finger of a user when said user is seated in the chair; and, (v) flexible cable means having a first end connected to said button means and a second end mechanically connected to said arm member whereby, when said button means is moved from said first position to said second position, said valve release member is moved to said open position so that the inclination of said chair back member of the chair may be adjusted and when said button means is moved from said second position to said first position, said valve release member is moved to said closed position so that the inclination of said chair back member is then fixed.

15. The chair as claimed in claim 14 further comprising a base member affixed proximate said valve release member, said arm member is pivotally mounted to said base member and movement of said arm member towards said base member causes said valve release member to move to said open position.

16. The chair as claimed in claim 15 wherein said button means includes cam means for pulling said cable means when said button means is moved from said first position to said second position such that, as said button means is moved to said second position, said arm member pivots with respect to said valve release member and moves said valve release member to said open position.

17. The chair as claimed in claim 16 wherein said chair back member is pivotally mounted on said seat member and said second section is pivotally mounted on said chair back member.

18. The chair as claimed in claim 17 wherein said chair back member is fixedly mounted on an attachment member, said attachment member is pivotally mounted on said seat member and said second section is pivotally mounted on said attachment member.

19. The chair as claimed in claim 16 wherein said buttons means has detent means for alternately maintaining said button means in said first position and said second position.

20. The chair as claimed in claim 15 wherein said button means is positioned in a housing and said button means travels inwardly into said housing as said button means passes from its first position to its second position.

21. The chair as claimed in claim 20 wherein said chair back member is moveable between an upright position and an inclined position and said fluid cylinder has spring means to bias said chair back member to said upright position.

22. The chair as claimed in claim 20 wherein a force from about 15 to about 20 lbs is required to move said valve release member from said closed position to said open position.

23. The chair as claimed in claim 20 wherein a force from about 5 to about 10 lbs is required to move said button means from said first position to said second position.

24. The chair as claimed in claim 23 wherein the distance between said first position and said second position of said button means is up to about ⅝ inch.

25. A chair comprising:

(i) a seat member and a chair back member;

(ii) said chair back member mounted on an attachment member, said attachment member pivotally mounted on said seat member whereby said chair back member may be moved between a first position and a second position to thereby adjust the inclination of said chair back member;

(iii) said seat member including a cylinder containing a non-compressible fluid having longitudinally extending telescopic first and second sections and a valve release member, said first section connected to said seat member and said second section pivotally mounted on said attachment member, said valve release member movable between a closed position in which said first and second sections are fixed in position relative to each other and an open position in which said first and second sections are moveable relative to each other;

(iv) actuating means operatively connected to said valve release member;

(v) button means positioned proximate said seat member and movable between a first position and a second position; and, (vi) flexible cable means having a first end connected to said button means and a second end mechanically connected to said actuating means whereby, when said button means is moved from said first position to said second position, said valve release member is moved to said open position so that the inclination of said chair back member of the chair may be adjusted and when said button means is moved from said second position to said first position, said valve release member is moved to said closed position so that the inclination of said chair back member is then fixed.

26. The chair as claimed in claim 25 wherein said actuating means comprises a base member affixed proximate said valve release member and an arm member pivotally mounted to said base member and movement of said arm member towards said base member causes said valve release member to move to said open position.

27. The chair as claimed in claim 26 wherein said button means includes cam means for pulling said cable means when said button means is moved from said first position to said second position such that, as said button means is moved to said second position, said arm member pivots with respect to said valve release member and moves said valve release member to said open position.

28. The chair as claimed in claim 25 wherein said chair has an arm rest member and said button means is positioned in said arm rest member and said button means travels inwardly into said arm rest member as said button means passes between said first and second positions.

29. The chair as claimed in claim 27 wherein said fluid cylinder has spring means to bias said chair back member to said first position.

* * * * *